US006124703A

United States Patent [19]

Krause et al.

[11] Patent Number: 6,124,703

[45] Date of Patent: Sep. 26, 2000

[54] VOLTAGE STABILIZER CONFIGURATION

[75] Inventors: Dieter Krause; Mike Vogel, both of Regensburg, Germany

[73] Assignee: Siemens Aktiengesellschaft, Munich, Germany

[21] Appl. No.: 09/184,175

[22] Filed: Nov. 2, 1998

[51] Int. Cl.[7] ..... G05F 1/40

[52] U.S. Cl. ..... 323/282

[58] Field of Search ..... 323/220, 223–226, 323/266, 271, 282, 285, 303

[56] References Cited

U.S. PATENT DOCUMENTS

| | | | |
|---|---|---|---|
| 3,733,540 | 5/1973 | Hawkins | 323/282 |
| 5,214,561 | 5/1993 | Morita | 361/187 |
| 5,528,125 | 6/1996 | Marshall et al. | 323/222 |
| 5,675,240 | 10/1997 | Fujisawa et al | 323/282 |

OTHER PUBLICATIONS

"Stabilisiertes Labor–Netzgerät für grossen Ausgangsspannungsbereich", Dieter Ulrich, Funkschau, Feb. 1970, Issue 2, pp. 51–52.

*Primary Examiner*—Matthew Nguyen

*Attorney, Agent, or Firm*—Herbert L. Lerner; Laurence A. Greenberg; Werner H. Stemer

[57] ABSTRACT

A voltage stabilizer configuration includes a voltage stabilizer having an in-phase-regulated actuator driven by a stabilized control voltage, a first network producing the control voltage and a second network. A stabilized output voltage is generated from a variable input voltage and is fed to a voltage regulator having a regulated output voltage supplying an electronic circuit and a reset circuit with voltage. A voltage signal of the electronic circuit and the input voltage are fed to the second network of the voltage stabilizer, so that a voltage is produced which is linked to the first network through an impedance. The voltage of the second network is approximately twice as large as the input voltage and interacts with the control voltage.

6 Claims, 1 Drawing Sheet

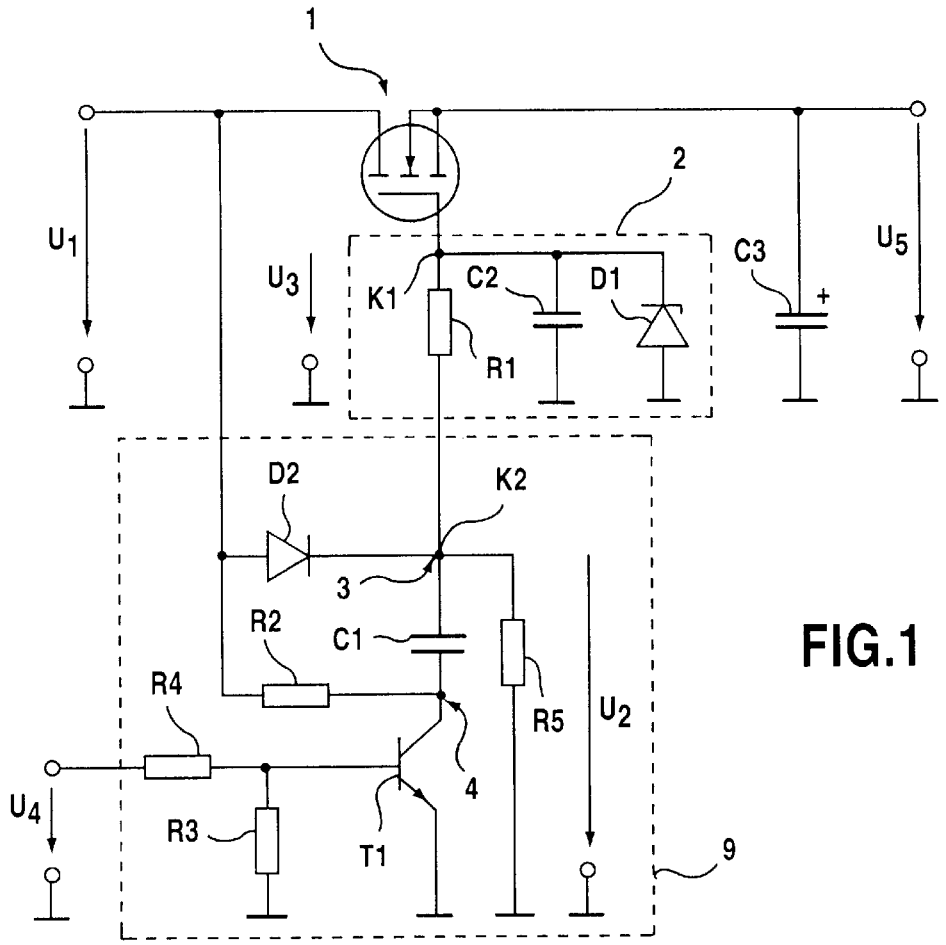
FIG.1
FIG.2
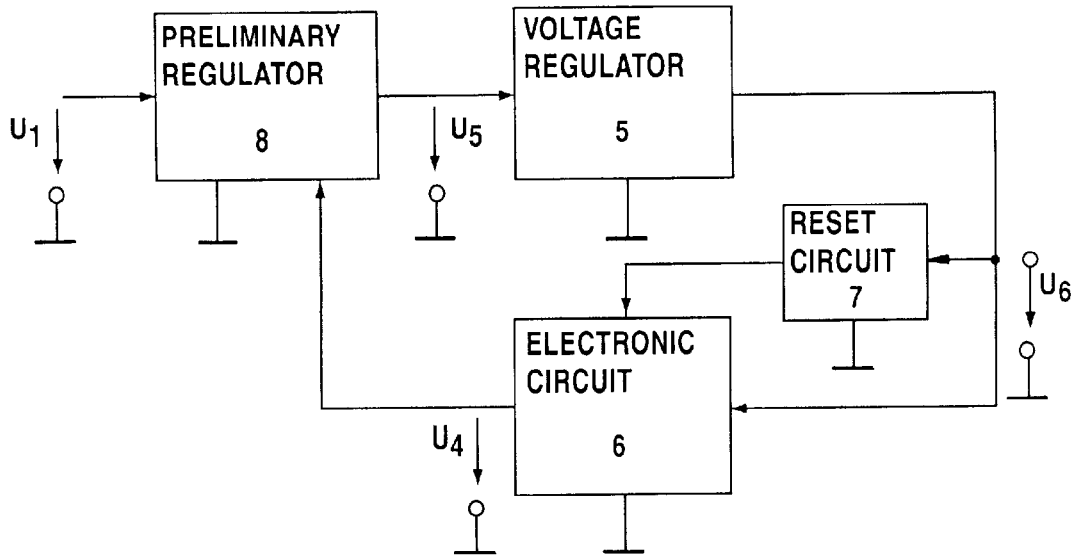

VOLTAGE STABILIZER CONFIGURATION

BACKGROUND OF THE INVENTION

Field of the Invention

The invention relates to a voltage stabilizer configuration having a voltage stabilizer for producing a stabilized output voltage from a variable input voltage.

Voltage stabilizers serve the purpose of producing a constant output voltage from a variable input voltage.

As a rule, voltage stabilizers operate with an in-phase-regulated transistor as an actuator, which has a control input driven by a stabilized control voltage. It is possible, given a constant control voltage, to largely stabilize the output voltage in a defined operating range, by way of the characteristic response of the transistor acting as the actuator.

The German journal "Funkschau" 1970, Issue 2, pages 51, 52 discloses a stabilized laboratory power supply unit which uses two series-connected in-phase regulators to produce a stabilized output voltage in a wide voltage range from a relatively slightly varying input voltage (the power supply voltage).

The stabilized output voltage serves, as a rule, to supply voltage to electronic circuits which are connected downstream and often have a dedicated voltage regulator for voltage supply.

Electronic circuits often have to be able to operate in a wide supply voltage range, even with supply voltages close to the minimum permissible supply voltage of the electronic components being used. Therefore, the minimum voltage drop between the input voltage and the supply voltage of the electronic components, wherein the voltage drop is caused by the stabilization circuit, should tend to zero, as far as possible.

Electronic circuits and their components are often exposed to high temperatures. When a specific operating temperature range is exceeded, the power loss of the components and of the circuit increases as a rule. That problem also applies to the voltage regulator, since the temperature and therefore the power loss in the voltage regulator increase approximately proportionally to the supply voltage.

A further appreciable problem is posed by undershooting of a minimum permissible supply voltage of the electronic components. In such a case, the electronic circuit is supposed to be reliably deactivated.

SUMMARY OF THE INVENTION

It is accordingly an object of the invention to provide a voltage stabilizer configuration:

- which overcomes the hereinafore-mentioned disadvantages of the heretofore-known devices of this general type,
- which enables a reliable operating behavior of the electronic circuit in a wide input voltage range, in particular for small input voltages,
- which enables reliable operation in a wide temperature range, in particular at high temperatures, and
- which reliably deactivates the electronic circuit to be supplied in the event of the minimum permissible supply voltage being undershot, in order to avoid malfunctions.

With the foregoing and other objects in view there is provided, in accordance with the invention, a voltage stabilizer configuration, comprising a voltage stabilizer for producing a stabilized output voltage from a variable input voltage, the voltage stabilizer having an electronically controlled, in-phase-regulating actuator driven by a stabilized control voltage derived from the variable input voltage, a first network producing the control voltage, and a second network; the first network of the voltage stabilizer having a first node at which the control voltage is present, and an impedance connected to the first node; a voltage regulator receiving the stabilized output voltage of the voltage stabilizer as an input voltage and producing a regulated output voltage; an electronic circuit and a reset circuit both receiving the regulated output voltage of the voltage regulator, the electronic circuit producing a voltage signal assigned to the regulated output voltage, and the reset circuit deactivating the electronic circuit in the event of an undervoltage; and the second network of the voltage stabilizer having a second node connected to the impedance, the second network receiving the voltage signal of the electronic circuit and the variable input voltage and producing a voltage at the second node influencing a voltage drop across the actuator through the impedance.

The voltage stabilizer configuration according to the invention has the essential advantage of minimizing the power loss in the voltage regulator and, as a result, of permitting it to be more easily dissipated.

The reliable deactivation of the voltage stabilizer in the event of undervoltage is ensured by the feedback-governed increase in the minimum voltage drop across the voltage stabilizer and the associated, abrupt reduction in the supply voltage of the electronic components down to an input voltage of 0 volts. In addition, the supply voltage range is only insignificantly limited by the voltage stabilizer connected upstream with regard to the lower voltage supply limit, or is negligible.

In accordance with another feature of the invention, the voltage signal of the electronic circuit is a control signal controlling an amplitude of the voltage at the second node between a single and a multiple amplitude value of the variable input voltage.

In accordance with a further feature of the invention, the voltage signal of the electronic circuit is pulse-width-modulated by the electronic circuit.

In accordance with an added feature of the invention, the second network is a charge pump having a transistor with a base driven by the voltage signal of the electronic circuit, an emitter at ground reference potential and a collector; a capacitor is connected between the second node and the collector of the transistor; a resistor is connected between the collector of the transistor and the input voltage; and a diode has a cathode connected to the second node and an anode connected to the input voltage.

In accordance with an additional feature of the invention, the in-phase-regulating actuator has a control terminal; the first network has a Zener diode with a cathode connected to the first node and to the control terminal of the in-phase-regulating actuator and an anode at ground reference potential; a capacitor is connected parallel to the Zener diode; the first node is connected through the impedance to the second node; and a resistor is connected between the second node and ground reference potential.

In accordance with a concomitant feature of the invention, the in-phase-regulated actuator is an enhancement-mode n-channel MOS field-effect transistor.

Other features which are considered as characteristic for the invention are set forth in the appended claims.

Although the invention is illustrated and described herein as embodied in a voltage stabilizer configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a basic schematic circuit diagram of a voltage stabilizer according to the invention, in which a feedback path is not illustrated; and FIG. 2 is a block circuit diagram with a voltage stabilizer as a preliminary regulator, in which the feedback path is illustrated.

DESCRIPTION OF THE PREFERRED EMBODIMENTS

Referring now to the figures of the drawings in detail and first, particularly, to FIG. 1 thereof, there is seen a voltage stabilizer having an electronically controlled, in-phase-regulating actuator bearing reference symbol 1, which is driven through the use of a stabilized control voltage $U_3$ at its control input. The control voltage $U_3$ is produced in a first network 2 of the voltage stabilizer and is present at a first node K1 of the network 2. The control voltage $U_3$ is stabilized and derived through the use of a second network 9 of the voltage stabilizer from a variable input voltage $U_1$ of the voltage stabilizer. The stabilization is essentially effected through the use of a Zener diode D1 in this exemplary embodiment.

The network 9 is preferably realized by a charge pump which is fed by the variable input voltage $U_1$, is controlled by a pulse-width modulated voltage signal $U_4$ and delivers a voltage $U_2$ as an output voltage. In the absence of the voltage signal $U_4$, the voltage $U_2$ is only smaller than the input voltage $U_1$ by a diode voltage, and in the presence of the voltage signal $U_4$, it has at most twice the value of the input voltage $U_1$.

A functional relationship between the variable input voltage $U_1$ and the derived voltage $U_2$ is afforded as being approximately linear with regard to the amplitudes in the realization provided through the use of the charge pump.

The Zener diode D1 for stabilization of the control voltage $U_3$ is part of the network 2 and is supplied by the voltage $U_2$ through a first resistor (impedance) R1. The first node K1 is a junction point between the first resistor R1 and a cathode of the Zener diode D1, and forms the control terminal of the in-phase-regulated actuator 1. An anode of the Zener diode D1 is connected to ground reference potential. Another capacitor C2 is connected between the first node K1 and ground reference potential. A further capacitor C3 is connected between the in-phase-regulated actuator 1 and ground reference potential. An output voltage $U_5$ of the voltage stabilizer is also shown.

The voltage $U_2$ derived from the input voltage $U_1$ is produced by the charge pump which has a capacitor C1 that is charged in a clocked manner. The capacitor C1 has a first terminal 3 at a second node K2 of the network 2 that is connected to a cathode of a diode D2 and to the first resistor R1. A fifth resistor R5 is connected between the node K2 and ground reference potential. An anode of the diode D2 is connected to the variable input voltage $U_1$. A second terminal 4 of the capacitor C1 is connected to a voltage-carrying electrode of an electronic switching element T1. The second terminal 4 is also connected through a second resistor R2 to the variable input voltage $U_1$. The electronic switching element T1 has a control input at which it is driven by the voltage signal $U_4$ through a resistor R4. Another resistor R3 is connected between the voltage signal $U_4$ and ground reference potential. An approximately linear relationship between the variable input voltage $U_1$ and the derived voltage $U_2$ is established through the use of the charge pump, in such a way that the amplitude of the derived voltage $U_2$ is at most twice as large as that of the variable input voltage $U_1$.

The in-phase-regulating actuator 1 and the electronic switching element T1 are preferably transistors. In particular, the in-phase-regulating actuator 1 is an enhancement-mode field-effect transistor and the electronic switching element T1 is a bipolar transistor.

According to FIG. 2, the voltage stabilizer is connected as a preliminary regulator 8 upstream of a voltage regulator 5. The voltage regulator 5 supplies an electronic circuit 6 and a reset circuit 7 with a voltage $U_6$. The reset circuit 7 switches off the electronic circuit 6 in the event of undervoltage. The electronic circuit 6 delivers the pulse-width-modulated voltage signal $U_4$ by which the electronic switching element T1 of the charge pump is driven at its control input. This feedback results in a hysteresis behavior with respect to the use and switching off of the electronic circuit 6 by the reset circuit 7 with regard to the input voltage $U_1$.

The voltage stabilizer connected as the preliminary regulator 8 serves to minimize power loss in the voltage regulator 5. The use of a power MOSFET as the actuator 1, in combination with the charge pump, affords an extremely low minimum voltage drop across the actuator. The electronic circuit 6 delivers a clock supply for the charge pump through the use of the voltage signal $U_4$. The use of power MOSFETs means that the charge pump can operate with very small capacitors C1, C2, and the steady-state condition of the circuit is reached as early as after a few milliseconds.

During the turn-on operation, the charge pump cannot yet be clocked by the voltage signal $U_4$ of the electronic circuit 6. Therefore, the minimum voltage drop across the voltage stabilizer connected as the preliminary regulator 8 is at least 3 to 4 V in the turn-on phase. This means that, until reliable operation of the charge pump, the variable input voltage $U_1$, during the initialization phase of the electronic circuit 6, must lie above the minimum permissible voltage for $U_6$ as the supply voltage for the electronic circuit 6, at least by the magnitude of the threshold voltage of the actuator 1 (approximately 3 to 4 V) and the minimum voltage drop across the voltage regulator 5. As soon as the charge pump is driven in a clocked manner by the voltage signal $U_4$ from the electronic circuit 6, the voltage drop across the voltage stabilizer connected as the preliminary regulator 8 decreases within a few milliseconds to its minimum value of approximately 30 mV. As a result, starting from this instant, the input voltage $U_1$ can fall to a magnitude which has to be only approximately 30 mV above the minimum permissible value of a voltage $U_5$, and the minimum permissible voltage $U_6$ for the voltage supply of the electronic circuit 6 is only just not undershot.

The production of the voltage signal $U_4$ for the charge pump from the electronic circuit 6 simultaneously affords a further advantage. If the regulated output voltage $U_6$ of the voltage regulator falls to such an extent that the reset circuit 7 responds, then the voltage signal $U_4$ for the charge pump is also interrupted. The high threshold voltage of the actuator 1, which is constructed as a power MOSFET, then in turn ensures that the output voltage $U_5$ of the voltage stabilizer connected as the preliminary regulator 8 falls abruptly by 3 to 4 V in the event of a failure of the voltage signal $U_4$. As a result, the supply voltage $U_6$ for the electronic circuit 6 likewise falls by this magnitude, the consequence of which is that the electronic circuit 6 is or remains reliably deactivated under all circumstances in the event of undervoltage. Consequently, the reset behavior of the circuit is significantly improved. Uncontrolled restarting of the circuit is impossible since, due to the absent voltage signal $U_4$, the charge pump does not operate, the voltage drop across the actuator 1 is at a maximum again and, consequently, the minimum turn-on voltage for $U_1$ must first be exceeded again.

The circuit according to the invention enables the maximum operating temperature to be increased, due to the reduction of the power loss in the voltage regulator 5, without the supply voltage range being noticeably limited.

We claim:

1. A voltage stabilizer configuration, comprising:

a voltage stabilizer for producing a stabilized output voltage from a variable input voltage, said voltage stabilizer having an electronically controlled, in-phase-regulating actuator driven by a stabilized control voltage derived from the variable input voltage, a first network producing the control voltage, and a second network;

said first network of said voltage stabilizer having a first node at which the control voltage is present, and an impedance connected to said first node;

a voltage regulator receiving the stabilized output voltage of said voltage stabilizer as an input voltage and producing a regulated output voltage;

an electronic circuit and a reset circuit both receiving the regulated output voltage of said voltage regulator, said electronic circuit producing a voltage signal assigned to the regulated output voltage, and said reset circuit deactivating said electronic circuit in the event of an undervoltage; and said second network of said voltage stabilizer having a second node connected to said impedance, said second network receiving the voltage signal of said electronic circuit and the variable input voltage and producing a voltage at said second node influencing a voltage drop across said actuator through said impedance.

2. The voltage stabilizer configuration according to claim 1, wherein the voltage signal of said electronic circuit is a control signal controlling an amplitude of the voltage at said second node between a single and a multiple amplitude value of the variable input voltage.

3. The voltage stabilizer configuration according to claim 1, wherein the voltage signal of said electronic circuit is pulse-width-modulated by said electronic circuit.

4. The voltage stabilizer configuration according to claim 1, wherein:

said second network is a charge pump having a transistor with a base driven by the voltage signal of said electronic circuit, an emitter at ground reference potential and a collector;

a capacitor is connected between said second node and the collector of said transistor;

a resistor is connected between the collector of said transistor and the input voltage; and a diode has a cathode connected to said second node and an anode connected to the input voltage.

5. The voltage stabilizer configuration according to claim 1, wherein:

said in-phase-regulating actuator has a control terminal;

said first network has a Zener diode with a cathode connected to said first node and to said control terminal of said in-phase-regulating actuator and an anode at ground reference potential;

a capacitor is connected parallel to said Zener diode;

said first node is connected through said impedance to said second node; and a resistor is connected between said second node and ground reference potential.

6. The voltage stabilizer configuration according to claim 1, wherein said in-phase-regulated actuator is an enhancement-mode n-channel MOS field-effect transistor.

* * * * *